United States Patent [19]

Carter

[11] 3,972,632

[45] Aug. 3, 1976

[54] EXPANDABLE BOOK COVER

[75] Inventor: Leewood C. Carter, Warren Township, Somerset County, N.J.

[73] Assignee: Book Covers, Inc., Newark, N.J.

[22] Filed: Mar. 11, 1975

[21] Appl. No.: 557,335

[52] U.S. Cl. ..... 402/46; 402/75; 281/25 R; 281/29

[51] Int. Cl.[2] ..... B42F 13/12

[58] Field of Search ..... 402/46, 47, 48, 49, 402/50, 51, 52, 53, 54, 55, 56, 57, 74, 77, 3; 281/36

[56] References Cited

UNITED STATES PATENTS

| | | | |
|---|---|---|---|
| 697,092 | 4/1902 | Krohn | 402/56 X |
| 777,798 | 12/1904 | Manger | 402/57 |
| 838,323 | 12/1906 | Halpin | 402/46 |
| 859,630 | 7/1907 | Thompson | 402/51 |
| 1,827,462 | 10/1931 | Crump | 402/47 |
| 1,911,358 | 5/1933 | Gaertig | 402/53 |
| 2,099,472 | 11/1937 | Emery | 402/74 X |
| 2,129,799 | 9/1938 | Viens | 402/3 X |
| 2,335,047 | 11/1943 | Ellis | 402/77 |

FOREIGN PATENTS OR APPLICATIONS

| | | | |
|---|---|---|---|
| 1,216,406 | 11/1959 | France | 402/64 |

*Primary Examiner*—Jerome Schnall
*Attorney, Agent, or Firm*—Thomas M. Marshall

[57] ABSTRACT

An expandable cover for books is provided for storing, protecting and labeling data processing sheets, accounting records, and the like, comprising a pair of cover boards hinged to corner members which carry openings for receiving sheet attaching means, spine elements for the back of the book cover which have at least one opening for receiving a back or spine protecting element therein, or alternatively, an expandable element such as a foldable material, stretchable material, or further alternatively, a slot in one of the spine elements which slidably engages the second spine element by means of a rivet like member.

1 Claim, 13 Drawing Figures

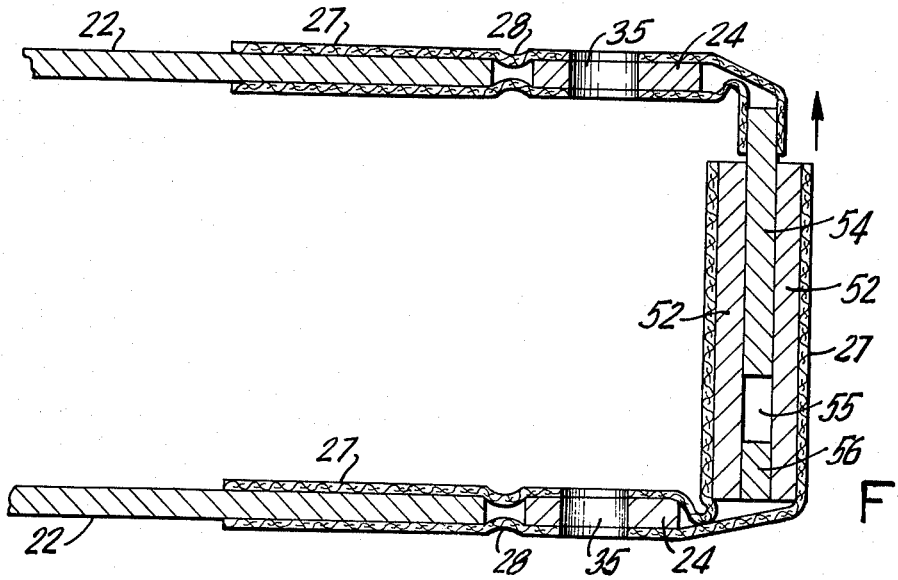
FIG. 9
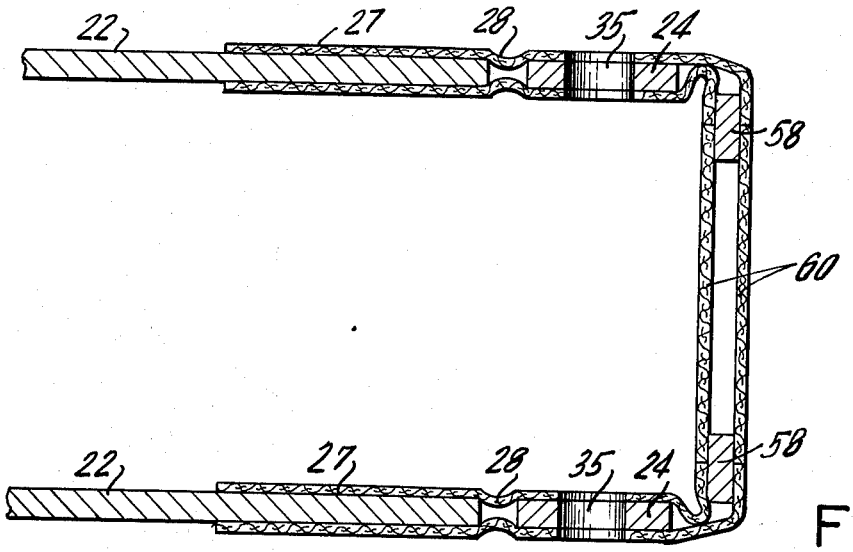
FIG. 11
FIG. 12
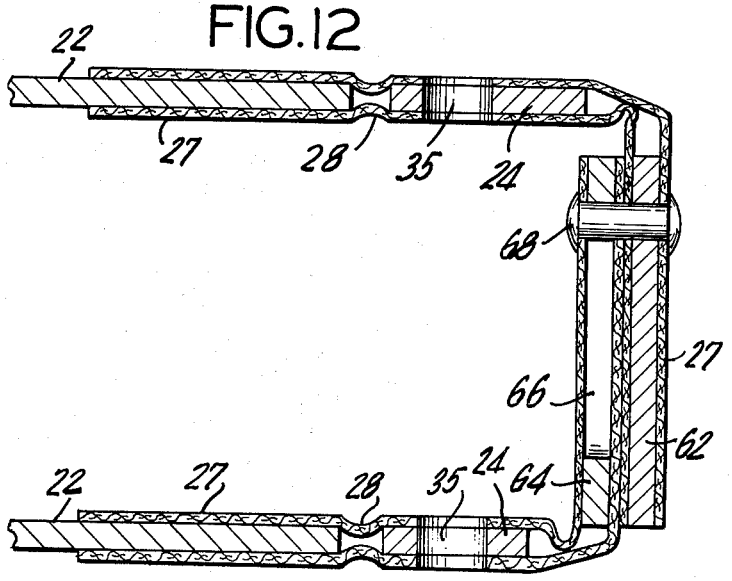
FIG. 13
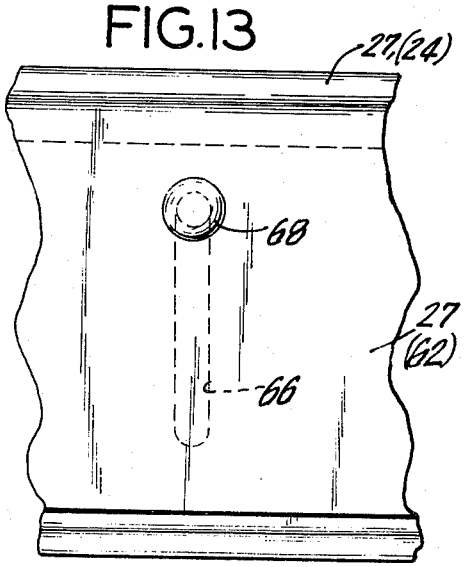

EXPANDABLE BOOK COVER

SUMMARY OF THE INVENTION

There are many kinds of records which need to be kept in a collection in a form of a book or books which are constantly expanding as additional materials are added. The object of this invention, therefore, is to provide an expandable cover which will provide protection and covering for the spine portion of such records as the materials are added. The spine covering element also provides space on which may be placed labels or marking indicia so that the contents of such book may be identified without removal of the book of records.

This object is accomplished by a pair of leaf boards which are hingedly connected to corner members which in turn are attached to one or more spine protecting elements which have a capability of expanding as additional materials are added.

In one form of the construction, a pair of openings are provided in the spine members which slidingly engage a spine protecting element so that as the materials are added, the spine protecting elements can move outwardly and, at the same time, the expandable element will continue to cover and protect this spine of the books.

In an alternate embodiment, one of the spine protecting elements, has a slot which receives the expandable element which is attached to the other of the two spine protecting elements. Alternate means of providing the opening are illustrated in the Figures. In still other forms, a fold of material is attached to the spine protecting elements which will gradually expand as the additional materials are added.

In still a further embodiment, the length of stretch cloth material is attached to the spine protecting elements which has sufficient elasticity to permit its expansion throughout the normal thickness of the book as it grows when additional materials are added.

In a further illustration of the subject of this invention, a pair of spine protecting elements are joined together by a rivet which passes through a slot in one of the members and thus permits the guidance and the expansion of the spine protecting elements as additional materials are added.

DESCRIPTION OF THE DRAWINGS

FIG. 5 is an enlarged partial cross-sectional view of the book cover elements of the embodiment illustrated in FIGS. 1–4, including the attaching post but omitting the data processing sheets or the like;

FIG. 9 is a partial cross-sectional end view of a further alternate embodiment of the book cover elements of this invention;

FIG. 11 is a partial cross-sectional end view of an alternate embodiment of the book cover elements of this invention;

FIG. 12 is a partial cross-sectional end view of a still further alternate embodiment of the book cover elements of this invention; and FIG. 13 is a partial view of the spine assembly of the embodiment of this invention illustrated in FIG. 12.

DESCRIPTION

Figure 1:
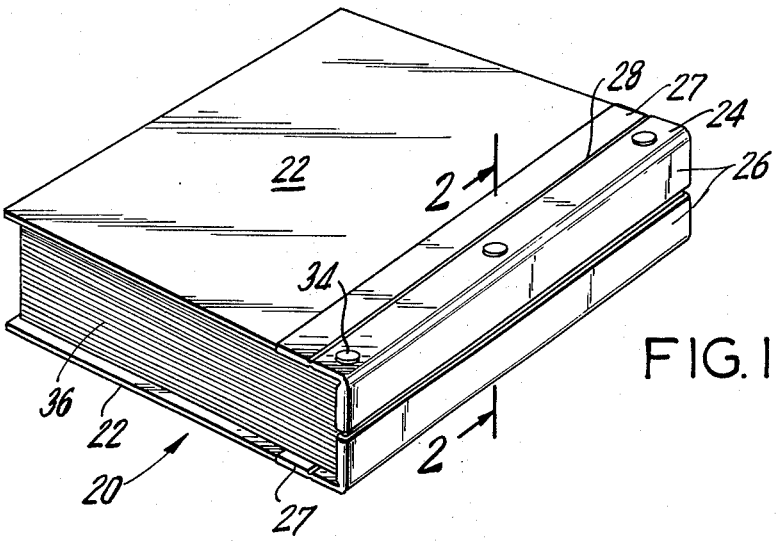
FIG. 1 is a perspective of one preferred form of the expandable book cover of this invention assembled with data processing sheets or the like as that book is intended to be used.
Figure 2:
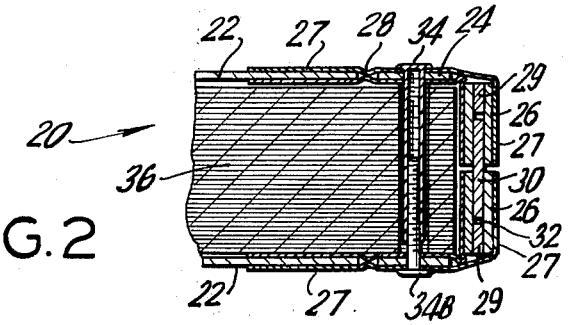
FIG. 2 is a partial cross-sectional side view of the book cover assembly shown in FIG. 1 taken on the line 2—2 of FIG. 1.
Figure 3:
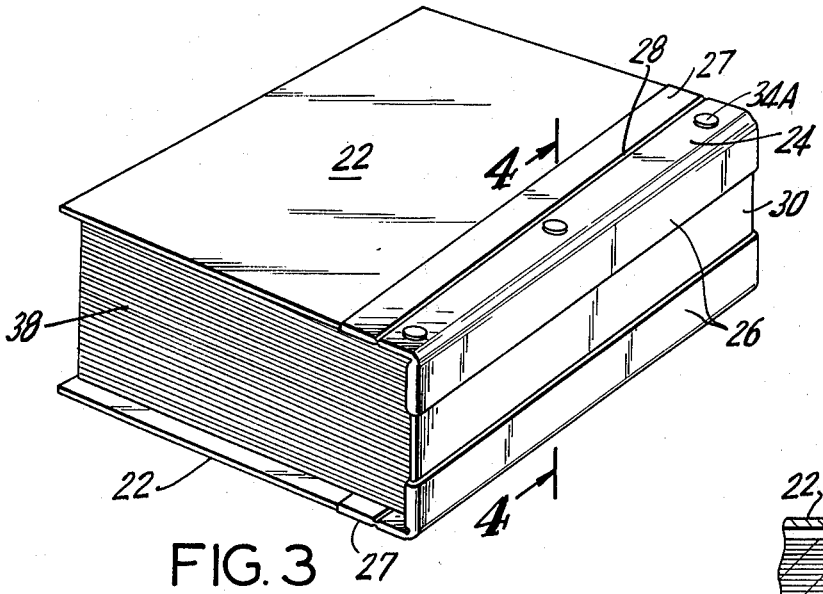
FIG. 3 is another perspective view of the book cover and assembly of the type shown in FIG. 1 with the assembly being considerably thicker than that illustrated in FIG. 1 because of the addition of a substantial plurality of sheets of material.
Figure 4:
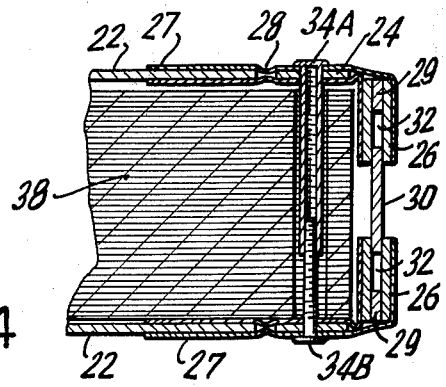
FIG. 4 is a partial cross-sectional view of the book cover and assembly of FIG. 3 taken along the line 4—4 of FIG. 3.
Figure 5:
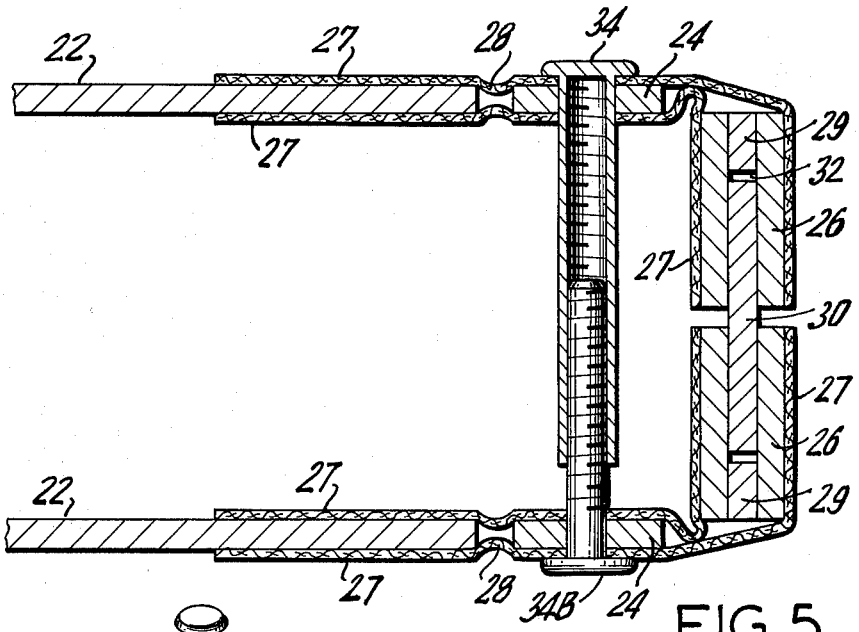
Figure 6:
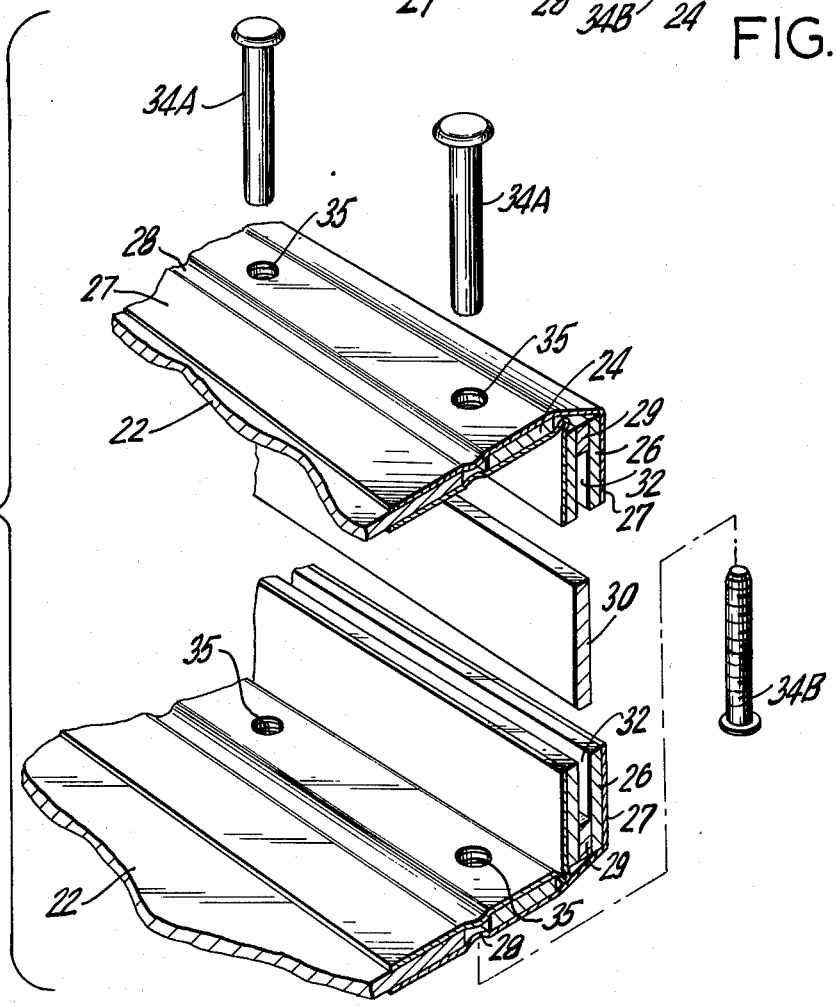
FIG. 6 is an exploded perspective partial cross-sectional view of the case made book cover elements illustrated in FIG. 5 demonstrating the assembly of the elements to complete the formation of the elements into a completed book.

A book, indicated generally at 20, of data processing sheets 36, assembled with the expandable book cover of this invention, is illustrated in FIGS. 1–6. The book cover elements comprise a pair of leaf boards 22 which are joined with corner members 24 which in turn are joined to spine protecting elements 26 by means of a case made folded cloth 27 to provide a hinge 28 between the leaf boards and the corner members 24. As can be seen in FIGS. 2, 4, 5 and 6, there is also provided an expandable element 30 which is slidably engaged in the opening 32 provided between the two pieces or members which form the spine protecting elements 26. As shown in FIGS. 2 and 4, a spacer element 29 is joined to the two pieces or members that form each half of the member 26 at the edges of the two pieces or members adjacent the front and back corner members 24.

Figure 7:
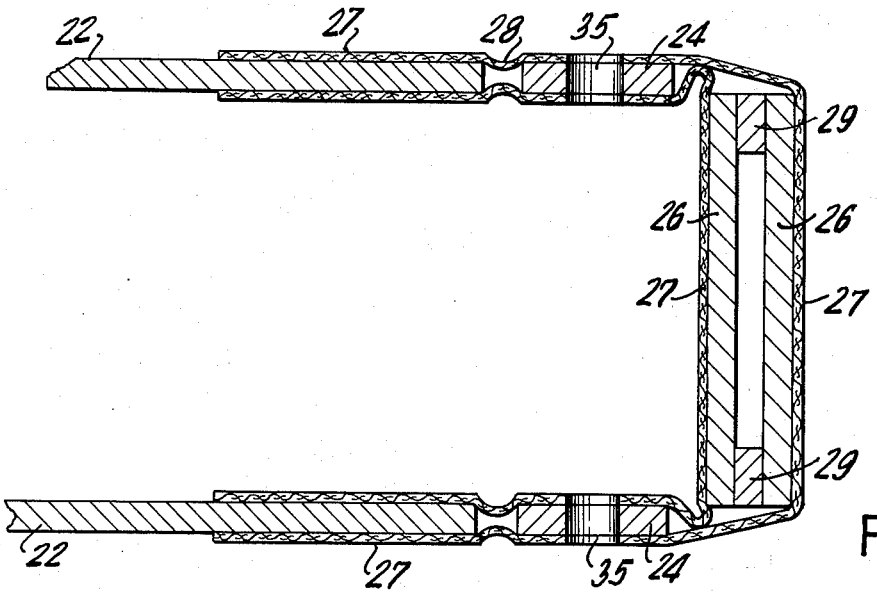
FIG. 7 is a partial cross-sectional end view of the book cover elements of the embodiment of FIGS. 1–6 at an intermediate stage of its manufacture, i.e., before the spine elements and case making cloth have been slit apart to provide the openings for receiving the expandable element.

Reference should be made to FIG. 7 which shows the book cover of FIGS. 1–6 at an intermediate stage of its manufacture. In that case, it will be noted that the elements 26 are continuous across the spine portion. In order to form the device as illustrated in FIGS. 1–6 at the center point of the members 26, they are cut to leave the opening 32 into which the expandable element 30 is fitted.

In FIG. 1 the book 20 is of moderate thickness including the number of sheets 36. In FIG. 3 a much thicker book is provided in which has a larger number of sheets 38. It will be seen by comparing FIGS. 2 and 4 that, as sheets are added, the space between openings 32 grows larger, and the spine of the book 20 can expand to the full width of the expandable element 30.

It should be understood that while the expandable element 30 is shown having a certain dimension, that that element could be made as wide as necessary and additional elements 30 of various widths could be provided to accomodate any thickness of book that is desired.

The book 20 and sheets 36,38 are held together by ordinary binder post means 34A, 34B. In the exploded perspective shown in FIG. 6, it can be seen that the sheets are assembled in the book cover by positioning them within the cover and then locating them and fixing them to the cover by means of the screw binder posts 34A, 34B. The holes 35 are provided through the corner members 24 for purposes of accommodating the barrel portion of the binder posts 34A, 34B.

Just as the expandable element 30 may have any appropriate width, similarly the binder posts 34A, 34B may be of any length suitable to accommodate the size of book that is desired.

In FIGS. 2, 4, 5 and 7 it will be seen that the case made cloth 27 extends on both sides of the leaf boards 22, corner members 24, and spine protecting elements 26.

Figure 8:
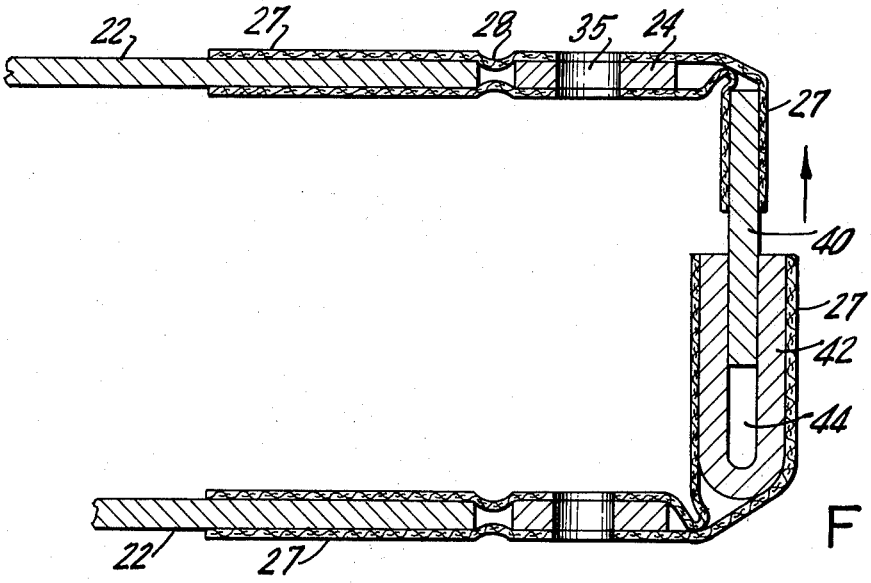
FIG. 8 is a partial cross-sectional end view of an alternate embodiment of the book cover elements of this invention.

Referring now to FIG. 8, an alternate version of the expandable book cover of this invention is illustrated in which the leaf boards 22 and the corner members 24 are the same as in the previous figures. However, there is provided an expandable element 40 attached by means of the cloth 27 to one of the corner members 24 as illustrated. The other of the spine protecting elements has a fold of material 42 which provides an opening 44 for receiving the expandable element 40. As before, the openings 35 are provided for elements similar to the screw binder posts 34A, 34B. In this embodiment, as additional sheets of material are added, the element 40 will move, as illustrated in FIG. 8, upwardly, thus providing for continued covering and protection of the spine portion of the book as additional materials are added.

A similar embodiment is illustrated in FIG. 9 except that in this case the elements 52 are substantially the same as elements 26 except that the opening 55 is provided between the two portions 52 of the spine protecting elements which are spaced apart by a spacer strip 56 as illustrated. Again, the leaf boards 22, the hinge area 28, the binder post receiving opening 35, and the corner elements 24 remain the same as does the case made cloth 27 which is attached as illustrated.

Figure 10:
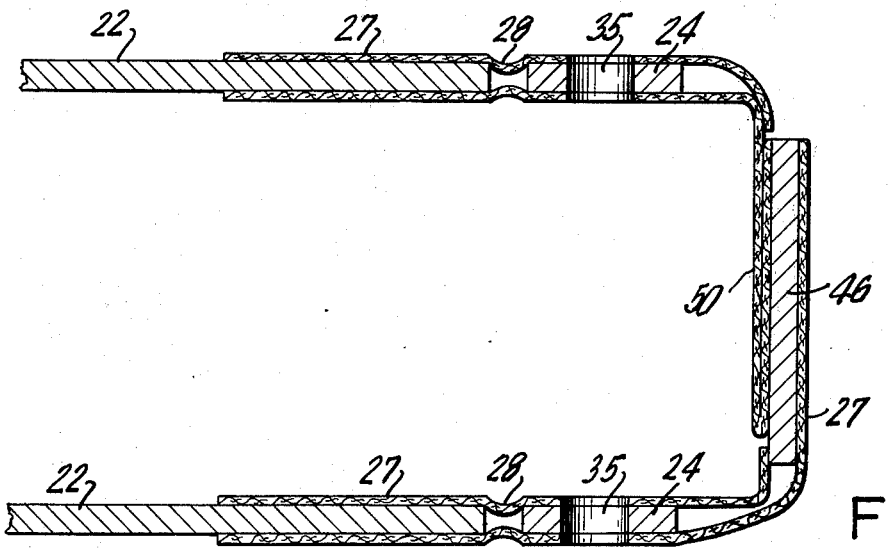
FIG. 10 is a partial cross-sectional end view of a still further alternate embodiment of the book cover elements of this invention.

In the embodiment illustrated in FIG. 10, the leaf boards 22, the corner elements 24, the hinge 28, and the binder post receiving openings 35 remain the same. In this case, there is a continuous spine protecting element 46 which is attached by means of the case made cloth method 27 to one of the two halves of the cover. The other of the two halves of the cover has attached to it a folded material 50 which underlies the spine protecting element. As additional material is added to the book, the fold, which will rest against the back of the sheets of material, will gradually expand thus providing continued protection and covering for the spine of the book.

In FIG. 11 the leaf boards 22 and the corner elements 24 remain the same along with the hinge area 28 and the binder post receiving openings 35. Elements 58 are provided which are attached to the corner elements 24 by means of the case made cloth 27, which, in this instance, may be a stretchable material 60 to provide for the amount of stretch anticipated to make the thickness of book that is desired.

Referring now to the embodiment illustrated in FIGS. 12 and 13, again the leaf board members 22 remain the same as does the case made cloth portions 27 which join the various elements 22, 24, and 62 together. Again, there is the hinge area 28 and the binder post receiving holes 35. In this particular embodiment, one of the spine protecting elements 62 is attached to the corner element 24 and the other of the two spine protecting elements 64 has provided in it a slot 66. A rivet like member 68 is attached to the spine protecting element 62 and passes through the slot 66. As shown in FIG. 13, the slot may have a length of any particular dimension that is desired to accommodate the thickness of book that is needed.

It will be understood that while various modifications of the device of this invention have been illustrated in FIGS. 1–13, that other modifications can be made within the spirit and scope of the claims appended hereto.

What is claimed is:

1. An expandable cover and a book of materials, such as data processing sheets, accounting records, and the like, comprising:

a pair of leaf boards overlying the front and back sides of said book forming the front and back covers of said book, case made folded cloth members adhesively joined to both the inside and outside of the inner ends of said cover boards and extending beyond them in spaced relationship, a pair of corner members adhesively secured on their inside and outside to said cloth members and spaced slightly from the inner ends of each of said cover boards to thereby hingedly join said cover boards to said corner members, said cloth members extending on both sides of said corner members and beyond them around the corners of said book in spaced relationship, means secured to each of said corner members and extending through said book for adjusting the spacing between the corner members, a pair of spine protecting and covering elements each comprising a pair of members separated at their edges adjacent the front and back of said book by narrow spacer strips joined to said pair of members to define an extensive opening between each of said members, said cloth members being adhesively connected to the outsides of each of said pair of members to join said pair of spine protecting and covering elements to said pair of corner members; and an element slidably positioned and received in said openings to completely cover and protect the spine of said book and permitting adjustment of the spacing between said front and back covers.

* * * * *